US007416455B2

(12) United States Patent
Salo et al.

(10) Patent No.: US 7,416,455 B2
(45) Date of Patent: Aug. 26, 2008

(54) FUSE HOLDER

(75) Inventors: Juho Salo, Vaasa (FI); Harri Mattlar, Iskmo (FI)

(73) Assignee: Abbsoyki, Helsinki (FI)

( * ) Notice: Subject to any disclaimer, the term of this patent is extended or adjusted under 35 U.S.C. 154(b) by 0 days.

(21) Appl. No.: 10/587,358

(22) PCT Filed: Feb. 2, 2005

(86) PCT No.: PCT/FI2005/000069

§ 371 (c)(1),
(2), (4) Date: Jul. 26, 2006

(87) PCT Pub. No.: WO2005/076306

PCT Pub. Date: Aug. 18, 2005

(65) Prior Publication Data

US 2007/0128941 A1 Jun. 7, 2007

(30) Foreign Application Priority Data

Feb. 3, 2004 (FI) ..... 20045025

(51) Int. Cl.
*H01R 11/11* (2006.01)

(52) U.S. Cl. ..... 439/833; 439/839

(58) Field of Classification Search ..... 439/830–833, 439/839

See application file for complete search history.

(56) References Cited

U.S. PATENT DOCUMENTS 3,927,929 A * 12/1975 Puetz ..... 439/831
3,984,801 A * 10/1976 Mrenna et al. ..... 337/252
4,472,018 A * 9/1984 Urani ..... 439/814
4,776,817 A * 10/1988 Jego et al. ..... 439/833
4,906,212 A 3/1990 Mixon, Jr.
4,913,678 A 4/1990 Avellino et al.
5,260,679 A 11/1993 Viscogliosi
5,295,850 A * 3/1994 Jeffcoat et al. ..... 439/266
5,559,662 A 9/1996 Happ et al.
5,739,737 A 4/1998 Hatton
5,841,337 A 11/1998 Douglass
6,459,353 B1 10/2002 Mattlar et al.
6,692,315 B1 2/2004 Soumillon et al.

FOREIGN PATENT DOCUMENTS

DE 100 55 035 A1 5/2002
GB 2 366 099 A 2/2002
WO WO 98/56075 A1 12/1998

* cited by examiner

*Primary Examiner*—Thanh-Tam T Le
(74) *Attorney, Agent, or Firm*—Buchanan Ingersoll & Rooney PC

(57) ABSTRACT

A fuse holder is disclosed which includes a frame, spring and a limiter,the frame having a first contact member and a second contact member adapted to receive an end of the fuse between them, the spring being adapted to press the contact member against the fuse end, and the limiter being adapted to define the largest possible depth of the fuse end in the installation direction between the first and second contact members. The spring includes a substantially circular arch-formed ring spring adapted to also serve as the limiter.

7 Claims, 1 Drawing Sheet

FUSE HOLDER

The present application claims priority under 35 U.S.C. §119 to Finland Application No. 20045025 filed on Feb. 3, 2004, and under 35 U.S.C. §371 to International Application No. PCT/FI2005/000069, filed Feb. 2, 2005, the contents of which are incorporated herein by reference in their entireties.

BACKGROUND OF THE INVENTION

The invention relates to fuse holders according to the preamble of the independent claim.

A known fuser holder comprises a frame provided with a first and a second contact member, between which one end of the fuse is placed, spring means for pressing the contact members against the end of the fuse for achieving an electrically conductive connection, and limiter means for defining the largest allowed depth of the fuse end in the installation direction between the contact members. In known fuse holders, the limiter means are achieved by frame design or with a separate component.

The problem in the above-described fuse holder is its complex structure.

BRIEF DESCRIPTION OF THE INVENTION

The object of the invention is thus to provide a fuse holder allowing the above problem to be solved. The object of the invention is achieved with a fuse holder, which is characterized in what is stated in the independent claim. Preferred embodiments of the invention are described in the dependent claims.

The invention is based on using the spring means also as the limiter means.

An advantage of the fuse holder of the invention is a simple structure that is easy to assemble.

BRIEF DESCRIPTION OF THE FIGURES

In the following, the invention will be described in more detail in connection with preferred embodiments with reference to the accompanying drawings, in which.

DETAILED DESCRIPTION OF THE INVENTION

Figure 2:
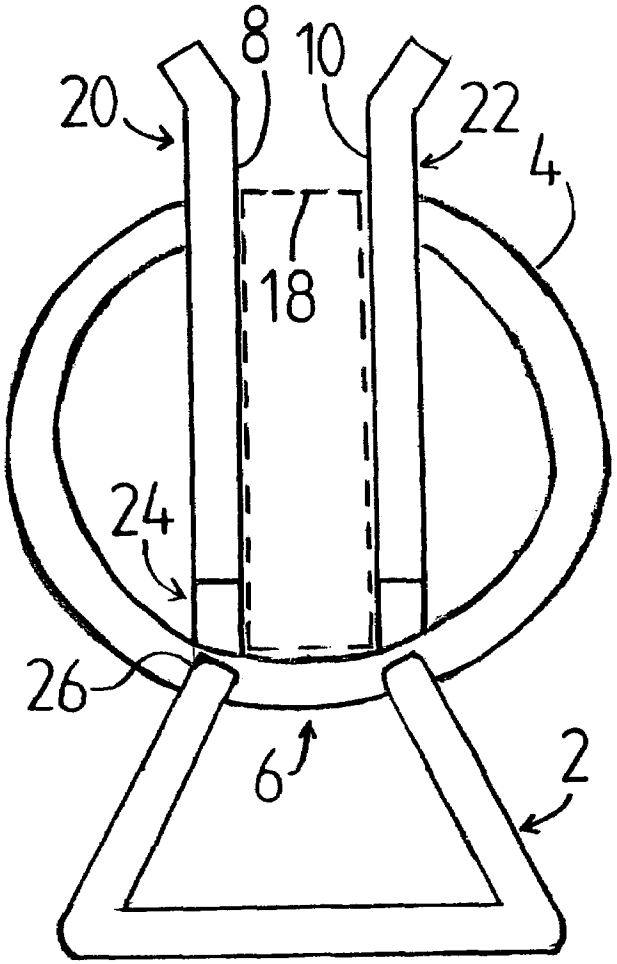
FIG. 2 shows the fuse holder of FIG. 1 seen in the axial direction.
Figure 1:
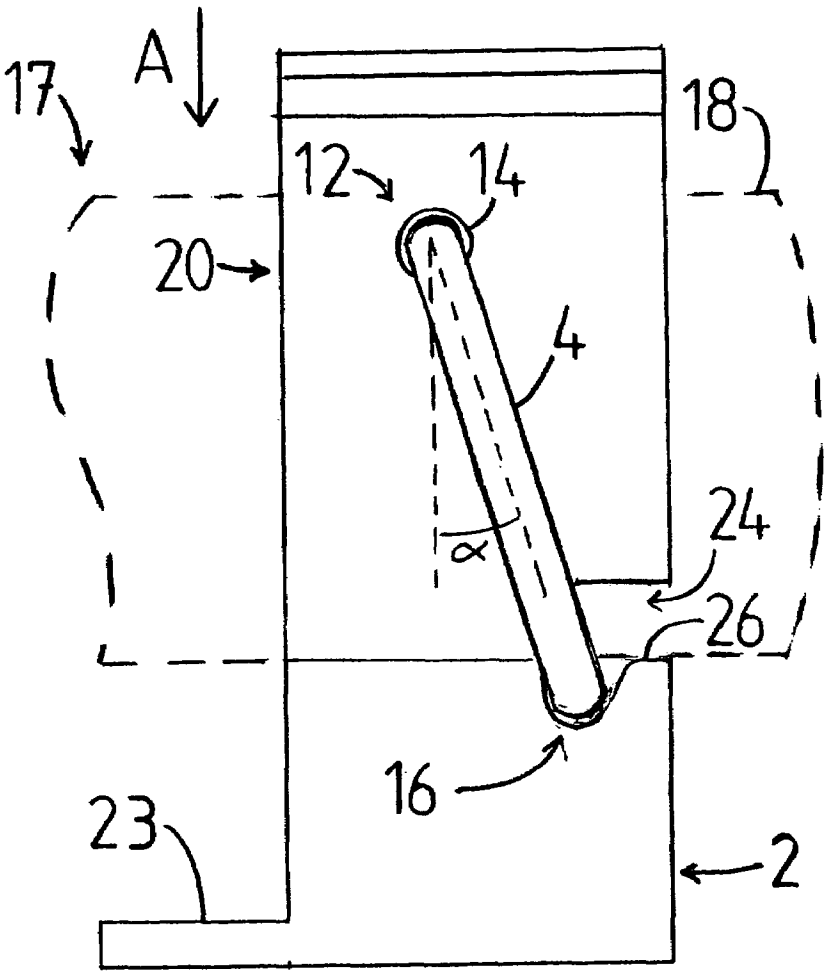
FIG. 1 is a side view of a fuse holder according to an embodiment of the invention.

FIGS. 1 and 2 show a fuse holder adapted to receive one end of a fuse. Accordingly, the installation of one fuse requires two fuse holders, the first of which receives a first axial end of the fuse, the second receiving a second axial end of the fuse. FIGS. 1 and 2 show, with a dashed line, an end 18 of a fuse 17, the end being adapted for an electric connection of the fuse 17.

The fuse holder of FIGS. 1 and 2 comprises a frame 2, spring means and limiter means 6. The frame 2 comprises a first contact member 8 and a second contact member 10 adapted to receive the fuse end 18 between them. The spring means comprise a ring spring 4 having substantially the form of a circular arch and adapted to also serve as the limiter means 6. The spring means are adapted to press the contact means 8 and 10 against the fuse end 18 to achieve an electrically conductive connection between the contact members and the fuse end 18. The limiter means 6, i.e. the middle portion of the ring spring 4, are adapted to define the largest possible depth of the fuse end 18 in the installation direction between the first 8 and second 10 contact members. Herein, the installation direction refers to the direction in which the fuse end 18 is moved between the contact members 8 and 10 during the installation of the fuse. In FIGS. 1 and 2, the installation direction is substantially vertical, and denoted by arrow A in FIG. 1.

In FIGS. 1 and 2, the fuse end 18 is at the largest possible depth in the installation direction between the contact members 8 and 10, the fuse end 18 being in contact with the middle portion located between the ends of the ring spring 4.

The cross-section of the frame 2 of the fuse holder is substantially U-shaped, and the frame is manufactured from one planar perform by bending. A first branch 20 of the frame 2 comprises the first contact member 8, and a second branch 22 of the frame comprises the second contact member 10. The contact members 8 and 10 are substantially vertical and substantially parallel.

FIG. 2 shows that the lower portion of the frame 2 broadens, whereby the branches 20 and 22 first diverge from one another such that they are at an about 30-degree angle relative to vertical, after which the branches 20 and 22 approach each other converging at the mid line of the fuse holder. The bottom of the frame 2 is substantially horizontal.

Because of the width of the lower portion of the frame 2, it is easy to fasten the fuse holder to an electrical appliance, such as a switch-fuse. The solidity of the fastening is also enhanced by a projection 23 at the bottom of the frame 2.

The fuse holder frame 2 according to the figures is made from an electrically conductive material. The frame 2 is preferably made from an elastic electrically conductive material, such as copper, whereby the frame 2 is able to assist the ring spring 4 by forcing the contact members 8 and 10 against the fuse end 18.

The frame 2 is provided with means 12 for holding the ends of the ring spring 4 in place. The means 12 for holding the ends of the ring spring in place comprise two recesses 14, each of which is provided on the outer surface of the corresponding branch of the frame 2. The recesses 14 are provided at the upper portion of the frame 2, i.e. the portion from whose direction the fuse end 18 is pushed in between the branches 20 and 22. The cross-section of each recess 14 is round, the recessed being adapted to receive the corresponding end of the ring spring. The mid lines of the recesses 14 are substantially parallel. The recesses 14 are provided in the branches 20 and 22 by punching.

FIG. 2 shows that the upper ends of the branches 20 and 22 of the frame 2 are bent outwards. Such a design facilitates the installation of the fuse end 18.

The ends of the ring spring 4 are installed in corresponding recesses 14. The ring spring 4 is located on a plane at a predetermined angle $\alpha$ relative to the installation direction of the fuse end 18. In the fuse holder of FIG. 1, angle $\alpha$ is about 15°, the ring spring 4 being directed outwards relative to the axial direction of the fuse 17. Alternatively, the ring spring 4 can be directed inwards relative to the axial direction of the fuse, the middle portion of the ring spring being axially closer to the middle portion of the fuse than the ends of the ring spring.

Angle $\alpha$ may vary between 0° and 90°. In the case of a fuse holder of the type of FIG. 1, angle $\alpha$ is preferably between 0° and 45°.

The frame 2 is provided with means 16 for supporting the middle portion located between the ends of the ring spring. The means 16 are intended to prevent the ends of the ring spring 4 from being detached from the recesses 14 during installation of the fuse end 18 into the fuse holder. The means

16 support the middle portion of the ring spring in a direction opposite relative to the installation direction of the fuse end.

The means 16 for supporting the middle portion of the ring spring comprise two slots 24, each being provided in the corresponding branch of the frame 2. The slots 24 in branch 20 and branch 22 are located and shaped as each other's mirror images relative to the mid line of the fuse holder.

Each slot 24 is located in the corresponding branch at the boundary of the vertical portion and the portion at an about 30-degree angle relative to vertical in such a manner that the slot extends in both said portions. In the axial direction of the fuse 17, each slot 24 extends to the corresponding branch of the frame along a stretch that is approximately triple relative to the thickness of the ring spring 4. The height of each slot 24, i.e. the dimension parallel to the installation direction of the fuse, is also about triple relative to the thickness of the ring spring 4.

The orifice of each slot 24 is provided with a projection 26 limiting the height of the orifice of the slot to about half of the total height of the slot. The projections 26 are shaped such that, with the ring spring 4 installed in the fuse holder, the ring spring is substantially unable to rotate around the axis passing via its ends, whereby the ring spring remains in its desired position.

Installing the ring spring in the frame 2 presented in FIGS. 1 and 2 is easy. In one alternative, the middle portion of the ring spring 4 is arranged to pass via the slots 24, after which the ends of the ring spring 4 are bend farther from one another, allowing them to be placed in the corresponding recesses. The branches 20 and 22 of the frame 2 can be bent towards one another to facilitate the installation.

In an alternative embodiment of the invention, the means 12 for holding the ends of the ring spring in position are so solid that no separate means 16 for supporting the middle portion located between the ends of the ring spring are required. For example, providing sufficiently deep recesses 14 ensures that the ends of the ring spring 4 are not detached from the recesses, even though the fuse end 18 directs forces in the installation direction to the middle portion of the ring spring.

The fuse holder shown in the figures is adapted for fuses with ends whose cross-sections are in the form of a rectangular parallelogram. The contact members of the fuse holder according to the invention may also be adapted suitable for other types of fuses.

It is obvious to a person skilled in the art that the basic idea of the invention can be implemented in a variety of ways. Consequently, the invention and its embodiments are not restricted to the above examples, but can vary within the scope of the claims.

The invention claimed is:

1. A fuse holder comprising a frame, spring means and limiter means, the frame comprising a first contact member and a second contact member adapted to receive an end of a fuse between them, the spring means being adapted to press the contact members against the fuse end to achieve an electrically conductive connection between the contact members and the fuse end, and the limiter means being adapted to define a largest possible depth of the fuse end in an installation direction between the first and second contact members, wherein the spring means comprise a ring spring having substantially a form of a circular arch and serving as the limiter means;

wherein the frame is provided with slots for supporting a middle portion located between ends of the ring spring;

wherein the slots are provided with projections configured to prevent the ring spring from rotating around an axis passing via the ends; and wherein the ring spring is placed in such a manner that when the fuse end is at said largest possible depth in the installation direction between the contact members, the fuse end is in contact with the middle portion located between the ends of the ring spring.

2. A fuse holder as claimed in claim 1, wherein the ring spring is located substantially on a plane that is at a predetermined angle ($\alpha$) relative to the installation direction of the fuse end.

3. A fuse holder as claimed in claim 2, wherein said predetermined angle ($\alpha$) is between 0 ° and 45°.

4. A fuse holder as claimed in claim 1, wherein the frame is provided with means for holding the ends of the ring spring in place.

5. A fuse holder as claimed in claim 4, wherein said means for holding the ends of the ring spring in place comprise two recesses provided in the frame, each recess being adapted to receive a corresponding end of the ring spring.

6. A fuse holder as claimed in claim 1, wherein the means for supporting the middle portion located between the ends of the ring spring are adapted to support the middle portion of the ring spring in a direction opposite relative to the installation direction of the fuse end.

7. A fuse holder as claimed in claim 1, wherein the cross-section of the frame is substantially U-shaped in such a manner that a first branch of the frame comprises the first contact member, and a second branch of the frame comprises the second contact member.

* * * * *

UNITED STATES PATENT AND TRADEMARK OFFICE

CERTIFICATE OF CORRECTION

PATENT NO. : 7,416,455 B2
APPLICATION NO. : 10/587358
DATED : August 26, 2008
INVENTOR(S) : Juha Salo et al.

It is certified that error appears in the above-identified patent and that said Letters Patent is hereby corrected as shown below:

On the Title Page,
Item 73 (Assignee): change "Abbsoyki, Helsinki (FI)" to --ABB Oy, Helsinki (FI)--.

Signed and Sealed this

Ninth Day of December, 2008

JON W. DUDAS
*Director of the United States Patent and Trademark Office*